US005166665A

United States Patent [19]

McCarthy

[11] Patent Number: 5,166,665

[45] Date of Patent: Nov. 24, 1992

[54] SELF-CONTAINED AUDIBLE ALARM ASSEMBLY

[76] Inventor: Robert F. McCarthy, 2349 Madison Rd., Cincinnati, Ohio 45208

[21] Appl. No.: 716,698

[22] Filed: Jun. 17, 1991

[51] Int. Cl.[5] ..... G08B 13/08; H01H 3/16

[52] U.S. Cl. ..... 340/546; 200/61.73; 340/691

[58] Field of Search ..... 340/546, 665, 574, 384 E, 340/691; 200/61.71, 61.73, 61.74

[56] References Cited

U.S. PATENT DOCUMENTS 4,888,578 12/1989 Conemac ..... 340/546

4,896,139 1/1990 Eldridge ..... 340/546

*Primary Examiner*—Jin F. Ng

*Assistant Examiner*—Thomas J. Mullen, Jr.

*Attorney, Agent, or Firm*—Frost & Jacobs

[57] ABSTRACT

A self-contained audible alarm assembly settable for actuation when subjected to an axial compressive force. The alarm assembly comprises a cylindrical body and a pair of end caps each comprising a circular base and an annular skirt. A first end cap is mounted on a first end of the body. A sound producing horn is captively mounted within the body adjacent the first end cap, the base of which is perforated to emit sound from the horn. A battery is located within the body. A pair of contacts is mounted within the body adjacent the second end thereof. Each contact has a portion extending slightly beyond the body second end. The battery and the horn are connected in series between these contacts. An electrically conductive disc is affixed to the inside surface of the base of the second one of the end caps. The disc touches the contacts completing the circuit and energizing the horn when the second end cap is fully seated on the second body end. Guide elements on the second end cap and on the body define an intermediate position for the second end cap wherein it is mounted on the second end of the body but not fully seated thereon. The guide means further define a position of the second end cap wherein the end cap may be shifted to its fully seated position by a compressive force to complete the circuit and energize the horn.

8 Claims, 2 Drawing Sheets

SELF-CONTAINED AUDIBLE ALARM ASSEMBLY

TECHNICAL FIELD

The invention relates to a self-contained audible alarm assembly, and more particularly to such an alarm assembly which is compact, rugged, and settable for actuation when subjected to an axial compressive force.

BACKGROUND ART

The alarm assembly of the present invention has many applications, as will be set forth hereinafter. An exemplary use for the alarm assembly of the present invention is found in its application to the protection of sliding glass doors of the type found in the home and elsewhere.

Sliding glass doors in the home, for example, are particularly vulnerable to illegal entry. As a consequence, prior art workers have devised numerous forms of electronic alarms and alarm systems to protect such doors. While such electronic alarm systems are effective, they are generally rather complex in nature and relatively expensive. Such systems frequently entail the provision of a push-button panel and require the entry of a code number and other manipulations to activate or deactivate the alarm system.

Prior art workers have also devised rod-like elements, some of which are adjustable in length, and which are intended to be located in or adjacent the door track to prevent opening of the door, even if the door latch or lock has been jimmied. Prior art workers have even incorporated electronic alarm devices in association with such rod-like elements which will both light a light and create an audible sound when the rod-like element is subjected to a compressive force during an attempt to slide one of the doors to its open position. Again, such a rod-like device with an electronic alarm incorporated therewith is relatively expensive and relatively delicate.

The present invention relates to an alarm assembly which may be used in conjunction with a rod-like element to preclude the opening of a sliding glass door and to provide an audible alarm if an attempt is made to gain illegal entry through the sliding glass door. The alarm assembly of the present invention is extremely simple in construction and is particularly compact and rugged. The alarm assembly is powered by a battery located within the alarm assembly itself, so that the alarm assembly is completely self-contained.

In a similar fashion, the alarm assembly of the present invention may be used to protect glass windows of the type which slide horizontally, as well as the more conventional double hung windows. Finally, the alarm assembly of the present invention is sufficiently compact that it may be easily carried in pocket or purse so as to serve as a personal alarm, as will be described hereinafter.

The ruggedness of the alarm assembly assures that it can withstand hard contact with a heavy sliding door. Once activated, the alarm assembly requires manual deactivation and thus will continue to sound even if the door or window is reclosed.

DISCLOSURE OF THE INVENTION

According to the invention there is provided a self-contained audible alarm of cylindrical configuration and which is settable for actuation when subjected to an axial compressive force. The alarm assembly comprises a cylindrical body with first and second ends and a pair of first and second end caps. Each end cap comprises a circular base portion and an annular skirt with an inside diameter substantially equal to the outside diameter of the alarm assembly body. The first end cap is mounted on the first end of the alarm assembly body. A battery operated electromechanical or electronic sound producing element or buzzer is captively mounted within the body adjacent the first end cap. The first end cap has at least one perforation formed therein to emit the sound from the buzzer.

A battery is located within the alarm assembly body. A pair of contacts is mounted within the alarm assembly body adjacent the second end thereof. Each contact has a portion extending slightly beyond the second end of the alarm assembly body. The battery and the buzzer are connected in series between these contacts. A disc of electrically conductive material is affixed to the inside surface of the base portion of the second end cap. The conductive disc touches the contacts to complete the circuit and energize the buzzer when the second end cap is fully seated on the second end of the alarm assembly body.

The second end cap is both rotatable and axially slidable with respect to the second end of the alarm assembly body. Guide elements on the skirt of the second end cap and on the body of the alarm assembly adjacent its second end define an intermediate position for the second end cap wherein it is mounted on the second end of the alarm assembly body but not fully seated thereon. The second end cap when in its intermediate 25c position is rotable between a first position wherein it can be axially shifted between its intermediate position and a position removed from the body, and a second position wherein it can be axially shifted between its intermediate position and its fully seated buzzer actuating position. When the second end cap is rotatively shifted to its second position, the alarm is primed and will be activated when subjected to an axial compressive force.

DETAILED DESCRIPTION OF THE INVENTION

Figure 1:
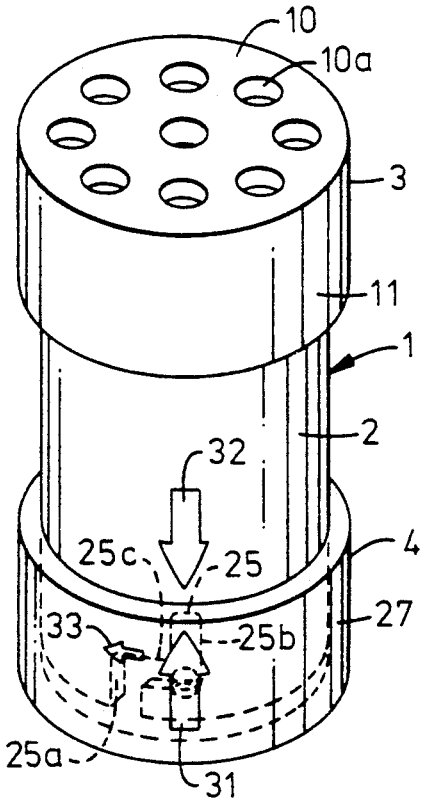
FIG. 1 is a perspective view of the alarm assembly of the present invention.
Figure 2:
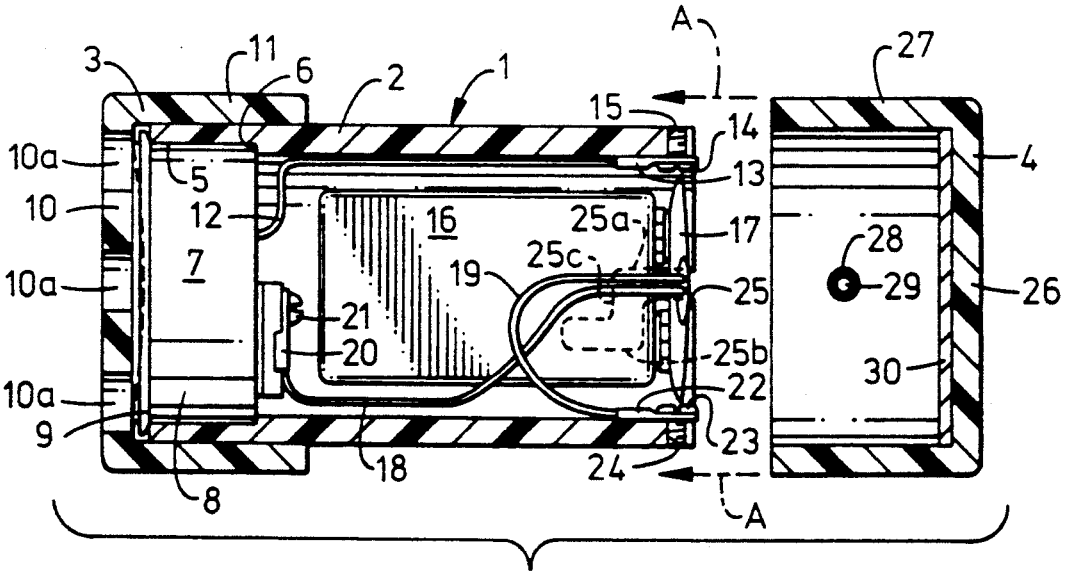
FIG. 2 is a partially exploded cross-sectional view of the alarm of the present invention.

In all of the FIGS., like parts have been given like index numerals. Reference is first made to FIGS. 1 and 2 wherein the self-contained audible alarm assembly of the present invention is generally indicated at 1. The alarm assembly 1 comprises a cylindrical body 2 provided at each of its ends with end caps 3 and 4. The body 2 is made of electrically insulative material. The end caps 3 and 4 are preferably also made of electrically insulative material. That end of body 2 adjacent end cap 3 is provided with an annular notch 5 forming an annular shoulder 6. The annular notch 5 is of such size as to just nicely accommodate a conventional electromechanical buzzer 7. The buzzer 7 will produce a loud, audible sound when connected across a conventional 9 volt transistor battery. Buzzers of the type illustrated at 7 are manufactured by numerous companies and are readily available in the marketplace. An exemplary buzzer for example, is manufactured by the Tandy Company of Fort Worth, Texas, under the trademark ARCHER* and the designation 273—051A. A conventional solid state audible alarm device could also be used.

The buzzer 7 has a cylindrical body 8, the rear end of which abuts the annular shoulder 6 of alarm assembly body 2.

The end cap 3 comprises a circular base portion 10 and an annular skirt 11. The skirt 11 has an internal diameter such as to just nicely receive the end of the cylindrical alarm assembly body 2. End cap 3 is mounted on the alarm assembly body 2 and is maintained thereon in any appropriate manner inclusive of the use of fastening means, the provision of a threaded engagement between end cap 3 and body 2, or simply by adhesive means. The inside surface of the end cap base portion 10 abuts the buzzer 7 and maintains it properly seated and captive within the annular notch 5 of the alarm assembly body 2. The base portion 10 of end cap 3 is provided with a plurality of perforations 10 so that the end cap 3 will not muffle the sound of buzzer 7.

The buzzer 7 has a lead 12 which terminates in a spade 13. The spade 13 is engaged with a contact 14 While the contact 14 may be of any appropriate type, it is illustrated in FIG. 2 as constituting a machine screw mounted in a threaded perforation 15 in the alarm assembly body 2. The machine screw 14 is of such length that it does not protrude beyond the periphery of the alarm assembly body 2. As a result, the machine screw 14 will not interfere with location of end cap 4 on the alarm assembly body 2. A 9 volt transistor battery is located within the alarm assembly body 2, as is shown at 16. A conventional snap-type connector 17 is provided for the battery 16. The connector 17 has a pair of leads 18 and 19. The lead 18 terminates in a spade 20 connected to a terminal 21 on the buzzer 7. The other lead 19, of the snap-type connector 17 terminates in a spade 22 engaged with a contact 23. The contact 23 may be of any appropriate type. For purposes of an exemplary showing, it is illustrated as being a machine screw, similar to machine screw 14. The machine screw 23 is engaged in a threaded perforation 24 in the alarm assembly body 2. Again, the machine screw 23 is of such length as to not protrude beyond the periphery of the alarm assembly body 2, and thus it will not interfere with end cap 4. From the above description it will be apparent that the circuit containing battery 16 and buzzer 7 would be completed and the alarm would be energized if contacts 14 and 23 were electrically connected.

The alarm assembly body 2 has a Z-shaped slot 25 formed therein. The Z-shaped slot 25 comprises a first portion 25*a* extending longitudinally from that end of the alarm assembly body 2 opposite the end having the annular notch 5. The Z-shaped slot 25 has a second longitudinally-extending portion 25*b* in parallel spaced relationship to the portion 25*a*. Longitudinal slot portions 25*a* and 25*b* are joined together by transversely extending slot portion 25*c*. The purpose of Z-shaped slot 25 will be apparent hereinafter.

End cap 4 is similar to end cap 3 in that it has a base 25*c*portion 26 and an annular skirt 27. The annular skirt 27 of end cap 4 has an internal diameter such as to just nicely receive the body 2 of the alarm assembly 25*c*. Annular skirt 27 is provided with a threaded perforation 28 in which a set screw 29 is mounted. Set screw 29 does not extend beyond the outer peripheral surface of the skirt 27 of end cap 4. Set screw 29 does, however, extend inwardly of the inner surface of skirt 27 of end cap 4. The purpose of set screw 29 is to serve as a follower in Z-shaped slot 25, as will be apparent hereinafter.

The alarm assembly is completed by the provision of a disc 30 of electrically conductive material. The disc 30 may comprise a metallic disc (as shown) or it may comprise a cardboard or fiber disc wrapped with metallic foil. The disc 30 is maintained in position in abutment against the inside surface of the base portion 26 of end cap 4 by any appropriate means including a force fit, adhesive means or the like.

A prototype of the alarm assembly 1 was made using Schedule 40 PVC 1 ¼" plumbing pipe for the body 1 and a 25*c*pair of plumbing end caps for 1 ¼" pipe. While dimensions do not constitute a limitation of the present invention, the body 2 had a length of about 2.85" and the end caps had a length of about 1.15". The prototype structure was very compact, having a maximum diameter of about 1.96" and an overall assembled length of about 3 5/16". The alarm assembly was extremely rugged. It would be appreciated by one skilled in the art that the body 2 and end caps 3 and 4 lend themselves well to being molded of an appropriate plastic material such as PVC or ABS.

The alarm assembly 1 having been described in detail, its operation can now be set forth. The user simply engages the snap-type connector 17 on the 9 volt transistor battery 16 and locates the battery 16 within the alarm assembly body 2, as shown in Figure 2. The removable end cap 4 is then located on the adjacent end of the alarm assembly body 2 with the set screw 29 aligned with portion 25*a* of Z-shaped slot 25. End cap 4 is advanced on the body 2 in the direction of arrows A until the set screw 29 bottoms in the Z-shaped slot portion 25*c*. Thereafter, end cap 4 is rotated in a counterclockwise direction with respect to the alarm assembly body 2 causing the set screw 29 to shift within the portion 25*c* of Z-shaped slot 25 until the set screw 29 reaches the end of slot portion 25*c*. It will be understood that the set screw 29 will now be aligned with the portion 25*b* of Z-shaped slot 25. At this point, the alarm assembly is primed and ready for use. A compressive force applied to the alarm assembly from either end will cause end cap 4 to shift further on the alarm assembly body 2 until the set screw 29 approaches the end of the portion 25*b* of the Z-shaped slot 25.

It will be noted from FIG. 2 that the heads of the contact screws 14 and 23 extend slightly beyond the adjacent end of the alarm assembly body 2. As a consequence, when the end cap 4 is fully seated on the alarm assembly body 2 and the set screw 29 approaches the end of Z-shaped slot portion 25*b*, the heads of the contact screws 14 and 23 will contact the electrically conductive disc 30. This completes the circuit containing the buzzer 7 and the battery 16, and the buzzer 7 will be actuated. It will be apparent to one skilled in the art that the buzzer 7 will continue to be actuated until end cap 4 is manually shifted away from its fully seated position and the heads of the contact screws 14 and 23 are no longer touching the electrically conductive disc 30. If end cap 4 is thereafter rotated in a counterclockwise direction until set screw 29 is no longer aligned with the portion 25*b* of the Z-shaped slot 25, the alarm assembly can be handled, transported or stored without fear of the buzzer 7 being energized, should the alarm assembly be subjected to an inadvertent compressive force.

It is within the scope of the invention to provide indicia on the alarm assembly to assist the user in the use thereof. For example, the skirt 27 of end cap 4 may be provided with a large arrow aligned with set screw 29 and extending longitudinally of the alarm assembly. Similarly, the body portion of the alarm assembly may be provided with a large arrow 32 aligned with the portion 25*b* of the Z-shaped slot 25. The arrows 31 and 32 point in opposite directions and are so arranged that when their heads are aligned as shown in FIG. 1, the user knows that the set screw 29 is aligned with portion 25*b* of Z-shaped slot 25, the alarm assembly primed for use. A small arrow 33 may be provided on the skirt 27 of end cap 4 to indicate the direction in which to rotate end cap 4 to shift the set screw 29 within the portion 25*c* of Z-shaped slot 25 and out of alignment with the slot portion 25*b*, thereby disabling the alarm assembly. If rotation in the direction of arrow 33 is continued until precluded, the user knows that the set screw is aligned with the portion 25*a* of Z-shaped slot 25 and the cap can be pulled rearwardly and off the alarm assembly body 2 for replacement of the battery 16.

It will be apparent that the Z-shaped slot 25 could be located in the skirt 27 of end cap 4 and the set screw 29 could be mounted in the alarm assembly body 2. In such an instance the operation of the alarm assembly would be substantially the same. The set screw or follower 29 could constitute a lug integrally formed on the inside surface of the skirt 27 or on the body 2 of the alarm assembly.

Figure 3:
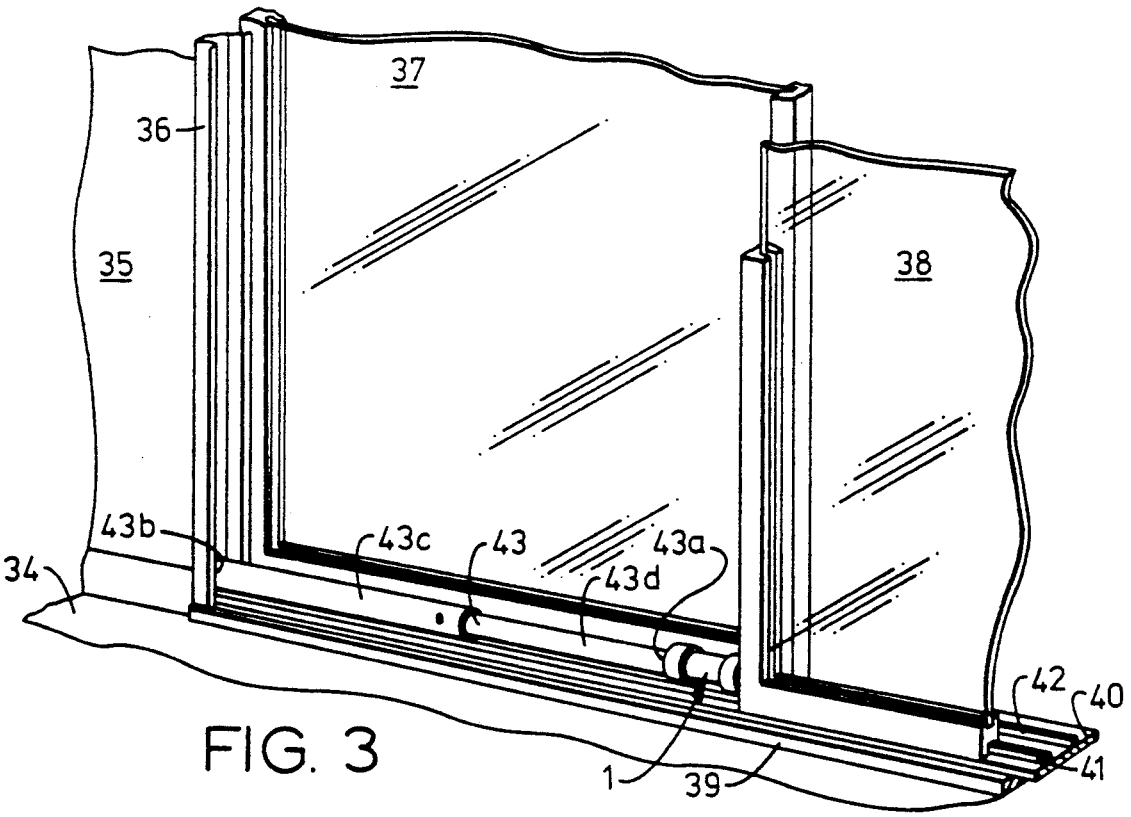
FIG. 3 is a fragmentary perspective view illustrating a assembly in its application to a sliding glass door assembly.

As indicated above, the alarm assembly of the present invention has numerous applications. An exemplary application constitutes its use as an alarm system for sliding glass doors of the type commonly found in the home or elsewhere. Reference is made to FIG. 3 wherein the wall and floor of the room of a structure are illustrated at 34 and 35, respectively. The wall 35 supports a frame 36 for a pair of siding doors 37 and 38. The floor 34 is provided with a threshold 39 supporting a track system 40 for the doors 37 and 38. In some installations, the outer door 37 is fixed and the inner door 38 is slidable between open and closed positions on a rail 41. In other instances, both doors are slidable, the outer door 37 being mounted on a rail 42.

Assuming, for purposes of an exemplary showing, that the outer door 37 is fixed, the alarm assembly 1 of the present invention can be employed in the following manner. The inner door 38 is slid to its closed position. The alarm assembly 1 is located on the track 40 resting on and between the rail 41 and the lower frame member of outer door 37, as shown in FIG. 3. One end of the alarm assembly 1 abuts the frame of inner door 38. An elongated rod-like member 43 is similarly positioned on the track 40. The rod-like member 43 is of such length that one of its ends 43*a* abuts or nearly abuts the alarm assembly 1, while the other of its ends 43*b* abuts door frame 36. It will be apparent that any attempt from the outside to shift door 38 toward its open position (to the left as viewed in FIG. 3), will apply a compressive force on the alarm assembly 1, causing the buzzer 7 thereof to be energized. The buzzer will remain energized until the alarm is manually reset by the user.

The nature of the rod-like element 43 is not a limitation of the present invention. The rod-like element 43 may be a unitary structure precut to the desired length. Alternatively, the rod-like element 43 may be made up of a pair of telescoping elements 43*c* and 43*d* so that it is adjustable in length, the rod-like element 43 being provided with means (not shown) to fix the elements 43*c* and 43*d* with respect to each other when the desired adjusted length is achieved. It would be within the scope of the present invention to provide a bracket (not shown) mounted on door frame 36, to which the end 43*b* of the rod-like element is pivotally affixed. In such an instance, the rod-like element 43 would be pivotable between an operative position as illustrated in FIG. 3 and an inoperative position extending vertically along door frame 36, when not in use.

In an instance where the outer door 37 is also slidable, the alarm assembly 1 of the present invention can be used in the same way just described, with one exception. In such an instance, the end 43*b* of rod-like member 43, instead of abutting or being attached to door frame 36, should abut or be attached to a bracket means (not shown) mounted on the frame of outer door 37. In such an instance, an attempt to shift either door 37 or 38 toward its open position will cause a compressive force on the alarm assembly 1, actuating the buzzer 7 thereof.

Figure 4:
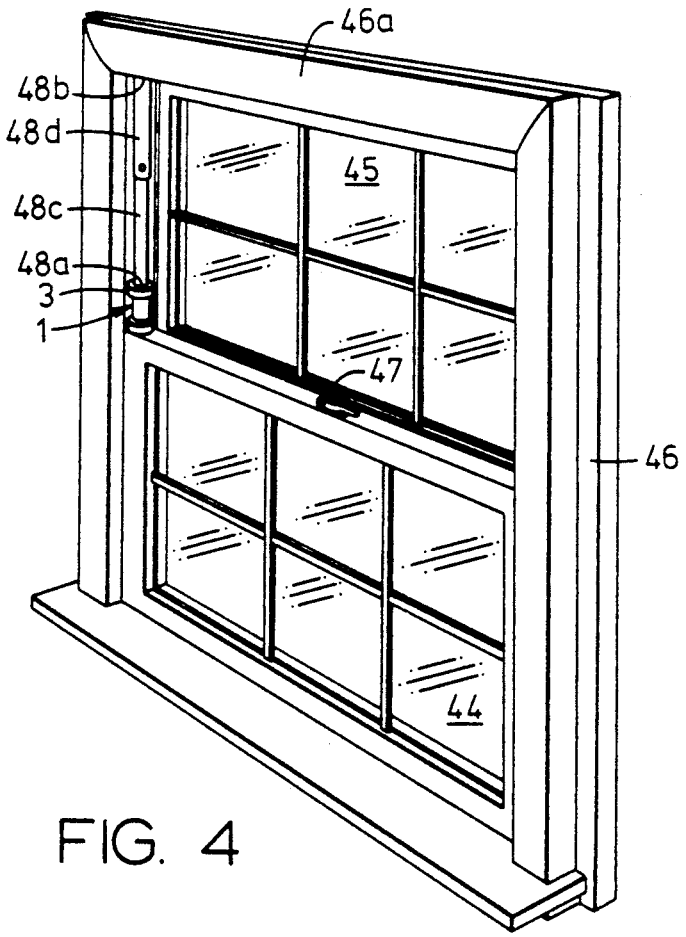
FIG. 4 perspective view illustrating the alarm assembly of the present invention in its application to conventional double-hung window.

It will be understood by one skilled in the art that the alarm assembly 1 may be used in substantially the same manner to form an alarm system for windows of the type which slide horizontally between open and closed positions. Another application of the alarm assembly 1 of the present invention is its use to protect a conventional double hung window assembly. Such a window assembly is illustrated in FIG. 4 and comprises a lower window 44, an upper window 45 and a window frame 46. As is well known, the windows 44 and 45 are capable of vertical movement within frame 46 between open and closed positions. When the windows 44 and 45 are in their closed positions, they may be locked by means of a conventional window lock 47.

In the use of the alarm assembly 1 of the present invention in association with the double hung window arrangement of FIG. 4, the alarm assembly 1 is placed vertically on the upper edge of lower window 44 with its perforated cap 3 preferably facing upwardly. An elongated rod-like member 48 is wedge between end cap 3 of alarm assembly 1 and an appropriate inside surface of the upper horizontal element 46*a* of window frame 46. With the lower end 48*a* of rod-like element 48 abutting the cap 3 of the alarm assembly 1 and the upper end 48*b* of the rod-like assembly abutting the window frame element 46*a*, it will be apparent that any attempt to raise lower window 44 will apply a compressive force to the alarm assembly 1, setting off the buzzer 7 therein.

Again the nature of the rod-like element 48 is not a limitation of the present invention. The rod-like element may be made up of two telescoping parts 48*a* and 48*b* with means (not shown) to clamp them together when the desired adjusted length of rod-like element 48 has been achieved. Preferably, the upper end 48*b* of the rod-like element is pivotally affixed to a bracket (not shown) mounted on the frame element 46*a*. In this way, the rod-like element 48 will normally occupy a vertical position as shown in FIG. 4, but can be swung to a horizontal position underlying the horizontal portion 46*a* of window frame 46 when the lower window 44 is in an elevated position. Alternatively, if the upper end 48*b* of rod-like element 48 were caused to abut a bracket extending from upper window 45, or to be pivotally attached to such a bracket, then the alarm assembly 1 would be subjected to a compressive force and the buzzer 7 thereof would be energized if an attempt were made to raise lower window 44, or to lower upper window 45.

It will be apparent from the above description that the alarm assembly 1 of the present invention is extremely simple in construction, rugged, and compact. Since the alarm assembly 1 can readily fit in a purse or pocket, it could be used as a personal alarm. For example, the alarm assembly 1 could be carried in pocket or purse with the cap 4 in a position such that the set screw is located within the portion 25*c* of Z-shaped slot 25. The end cap 4, under circumstances of an emergency, could be quickly manually rotated to locate set screw in alignment with the portion 25*b* of Z-shaped slot 25 and then shoved inwardly so as to cause the set screw 29 to enter the portion 25*b* of Z-shaped slot 25 and cause the contacts 14 and 23 to abut conductive plate 30, energizing the buzzer 7. Alternatively, the alarm assembly could be carried with cap 4 so positioned that the set screw 29 is in alignment with the portion 25*b* of Z-shaped slot 25, so that only a manual compressive force would be required to energize the buzzer 7.

Modifications may be made in the invention without departing from the spirit of it.

What is claimed is:

1. An alarm assembly comprising a one-piece cylindrical body with first and second ends and first and second end caps each comprising a circular base portion and an annular skirt having an inside diameter substantially equal to the outside diameter of said body, said first end cap being mounted on said first body end, a battery-operated, sound-producing buzzer captively mounted within said body adjacent said first end cap, said first end cap having at least one perforation in said base portion thereof to emit sound from said buzzer, a battery located within said body, a pair of contacts mounted within said body adjacent said second body end, each of said contacts having a portion extending slightly beyond said second end of said body, said battery and said buzzer being connected in series across said contacts, a disc of electrically conductive material being affixed to the inside surface of said base portion of said second cap, said conductive disc touching said contacts to complete said circuit and energize said buzzer when said second end cap is in a fully seated position on said second body end, said second end cap being both axially shiftable and rotatable on said second end of said body, means determining an intermediate position of said second end cap on said second end of said body short of said fully seated position and for determining a rotative position of said second end cap on said second end of said body wherein said second end cap can be shifted axially from said intermediate position to said fully seated buzzer-energizing position by an axial compressive force applied to said alarm assembly.

2. The alarm assembly claimed in claim 1 wherein said determining means comprises a Z-shaped slot on one of said body and said skirt of said second end cap and a follower slidable within said Z-shaped slot on the other of said body and said skirt of said second cap, said Z-shaped slot having a first rectilinear portion so positioned that travel of said follower therein permits insertion of said second end cap on said second end of said body to said intermediate position, said first portion of said Z-shaped slot terminating in a second rectilinear portion extending laterally therefrom at 90° thereto and so positioned that location of said follower therein renders said second end cap captive in said intermediate position, said second portion of said Z-shaped slot terminating in a third rectilinear portion extending laterally therefrom at 90° thereto in parallel spaced relationship with said first portion of said Z-shaped slot and so positioned that when said follower is located therein said second end cap can be shifted from said intermediate position to said fully seated buzzer-energizing position by an axial compressive force applied to said alarm assembly.

3. The alarm assembly claimed in claim 2 wherein said Z-shaped slot is formed in said body, said first rectilinear portion of said Z-shaped slot beginning at said second end of said body, said follower being located on the inside surface of said skirt of said second end cap.

4. The alarm assembly claimed in claim 2 wherein said buzzer comprises an electromechanical buzzer.

5. The alarm assembly claimed in claim 4 wherein said body and said end caps are molded of electrically insulative material.

6. The alarm assembly claimed in claim 5 wherein said Z-shaped slot is formed in said body, said first rectilinear portion of said Z-shaped slot beginning at said second end of said body, said follower being located on the inside surface of said skirt of said second end cap.

7. The alarm assembly claimed in claim 1 wherein said buzzer comprises an electromechanical buzzer.

8. The alarm assembly claimed in claim 1 wherein said body and said end caps are molded of electrically insulative material.

* * * * *